United States Patent [19]

Brenner et al.

[11] Patent Number: 4,662,125

[45] Date of Patent: May 5, 1987

[54] CENTRIFUGAL BLASTING MACHINE HAVING A ROTATABLE WORKPIECE HOLDER

[75] Inventors: Peter Brenner; Heinrich Fiala, both of Schaffhausen; Wolfgang Walter, Hallau, all of Switzerland

[73] Assignee: Georg Fischer Aktiengesellschaft, Schaffhausen, Switzerland

[21] Appl. No.: 764,223

[22] Filed: Aug. 9, 1985

[30] Foreign Application Priority Data

Aug. 10, 1984 [CH] Switzerland ..... 3844/84
Dec. 6, 1984 [CH] Switzerland ..... 5805/84

[51] Int. Cl.[4] ..... B24C 3/22; B24C 3/08

[52] U.S. Cl. ..... 51/419; 51/417; 51/421; 51/216 T; 51/217 T; 51/237 R; 269/218; 269/225

[58] Field of Search ..... 51/417, 419, 421, 216 T, 51/217 T, 237 R, 236, 217 R, 418; 269/57, 71, 218, 225, 254 CS

[56] References Cited

U.S. PATENT DOCUMENTS 57,447 8/1866 Stockmar ..... 269/218

FOREIGN PATENT DOCUMENTS 100944 2/1984 European Pat. Off. .
1244679 2/1963 Fed. Rep. of Germany ..... 269/254 CS
2510827 2/1977 Fed. Rep. of Germany .

*Primary Examiner*—Frederick R. Schmidt
*Assistant Examiner*—Bradley I. Vaught
*Attorney, Agent, or Firm*—Marmorek, Guttman & Rubenstein

[57] ABSTRACT

A holding device for workpieces, which is rotatably mounted in the side-walls of a centrifugal blasting machine, including a support member and holding member. Both members are pivotably mounted diametrically opposed with respect to the axis of rotation. By means of a pivot drive, both members can be simultaneously moved toward one another and away from one another. Through this, the holding device can be adjusted in each given case in such a manner, so that workpieces of different height can be retained in a centralized position with respect to the axis of rotation, in order to subject them in a rotating manner to a uniform centrifugal blasting treatment.

22 Claims, 13 Drawing Figures

CENTRIFUGAL BLASTING MACHINE HAVING A ROTATABLE WORKPIECE HOLDER

BACKGROUND OF THE INVENTION

This invention relates to a centrifugal blasting machine. More particularly, this invention relates to a centrifugal blasting machine having a rotating clamping device for the workpiece.

For the blasting treatment of predominantly cubically formed workpieces, such as for example cylinder blocks, cylinder covers, gear housing, etc., rotatable clamping devices or workpiece holders are required. These devices must ensure a secure hold of the workpieces and, at the same time, make possible an all-around blasting treatment. Thus, the devices should be designed in such a universal manner, so that workpieces of different sizes and shapes can be subjected to blasting treatments without the need for time-consuming exchanging operations.

A device for the conveying of cylinder blocks or similar workpieces through a centrifugal blasting machine is disclosed in German Patent No. 2,510,827, U.S. Pat. No. 4,121,387. In the device described therein, the workpiece clamping member has a fixed relationship with respect to the axis of rotation, so that concentric rotation of the workpiece is possible only if the workpiece is of the correct dimensions.

Thus, when no adjustments are made, subsequent workpieces of different heights are rotated eccentrically and no uniform blasting treatment is guaranteed. Moreover, the eccentric holding of the workpiece has a deleterious effect on the clamping members and on the rotational drive.

The workpiece holder disclosed in this cited patent is suitably preset only for cylinder blocks, so that time- and money-consuming exchange operations are necessary for other workpieces.

A centrifugal blasting machine having a different workpiece holder is disclosed in European Patent Application No. 100,944, filed on July 22, 1983. Although in this case the support plane of the holder can be adjusted with respect to the axis of rotation, separate adjusting devices with drives are required for adjusting the support plane and the gripping or holding members. As a result, the workpiece holder can become very expensive and is susceptible to breakdown.

It is an object of the present invention to provide a centrifugal blasting machine having at least one workpiece holding device by means of which workpieces of different form and size can be tightly retained in a position which is coaxial with the axis of rotation.

It is another object of the invention to provide such a centrifugal blasting machine which is less expensive to construct and less susceptible to breakdown than hitherto known centrifugal blasting machines. In particular, it is desirable that the centrifugal blasting machine be better protected against the centrifugal blasting means.

It is yet another object of the invention that the adjustment of the workpiece holding device for a given workpiece height be done automatically, so that a fully automatic operation, without manual adjustments, should also be possible for many different workpieces.

These and other objects are accomplished by means of the workpiece holding device of the present invention which comprises a support member having a support plane, a holding member having a holding plane, the support member and the holding member being diametrically opposed to one another, a bearing for rotatably bearing the support member and the holding member, rotation drive means for rotating the support member and the holding member about an axis of rotation, and adjustment means for pivotally adjusting the distance between the support member and the holding member so that they can receive and tightly retain the workpiece. The support member and the holding member are pivotable about respective pivot axes in such manner that the support plane and the holding plane are adjusted simultaneously and are at all times parallel to each other and equidistant from the axis of rotation. The adjust means includes a pivot drive.

Further advantageous refinements of the invention are described hereinbelow.

The workpiece holding device of the present invention can be adjusted, by means of a pivot drive, to the height of the workpiece to be subjected to the blasting treatment. After insertion of the workpiece, the same pivot drive can be used to tighten the clamping members so that the workpiece is tightly retained. Thereby, for the purpose of obtaining a uniform blasting treatment, the workpiece is retained in a position which is concentric with the axis of rotation.

By means of the disclosed embodiments and the drawings, the invention is illustrated in a simplified manner in the following.

DETAILED DESCRIPTION OF PREFERRED EMBODIMENTS

Figure 1:
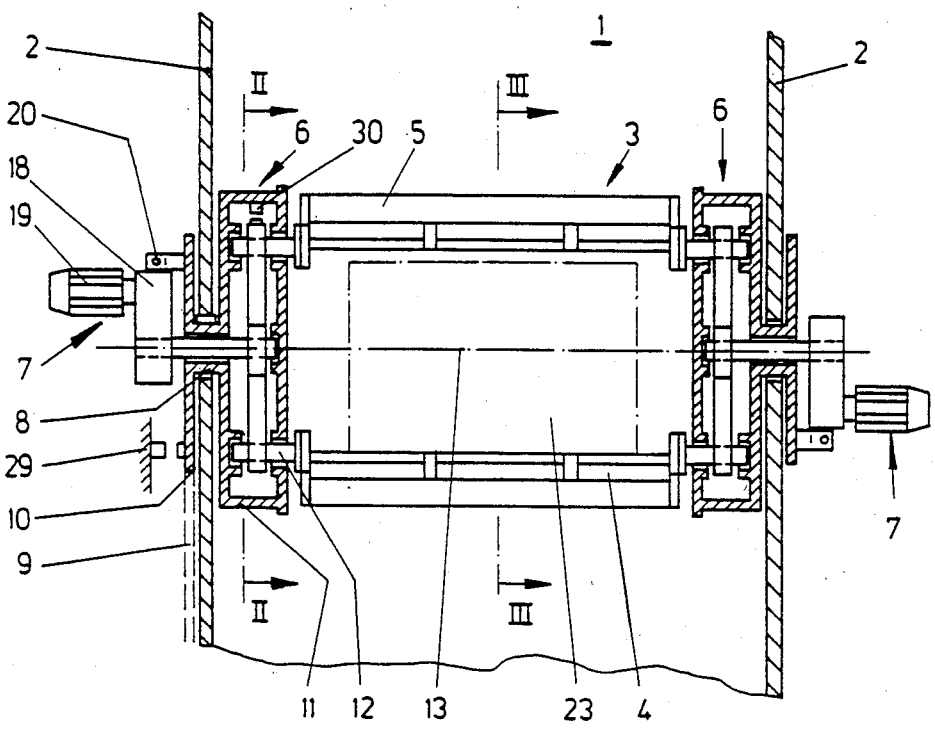
FIG. 1 shows a partial cross-section through a centrifugal blasting machine of the present invention having a rotatable workpiece holding device.

Referring to the drawings, FIG. 1 shows a blasting chamber 1 of a centrifugal blasting machine having side-walls 2 between which one workpiece holding device 3 is arranged.

The workpiece holding device 3 comprises lower and upper clamping members, referred to herein as workpiece supporting member 4 and holding member 5, and bearing parts 6 which are arranged on both side-walls 2 and are equipped with one pivot drive 7 each. In most cases, only one pivot drive 7 on one of the two bearing parts 6 is required. Pivot drive 7 adjusts the distance between supporting member 4 and holding member 5 as well as their orientation to each other.

Each bearing part 6 includes a hollow shaft 8, which is rotatably mounted in bearings of the side-wall 2 and is driven by means of a rotational drive 9 and, for example, by means of a chain wheel 10, which is mounted on the hollow shaft 8. The rotational drive is used for rotating the workpiece 23 about rotational axis 13. Along the side of the blasting chamber 1, the bearing part 6 is designed as a gear housing 11, in which the supporting member 4 and the holding member 5 are pivotably mounted by means of journal pins 12 in such manner that their axes 14 are arranged diametrically opposite from one another and at the same distance from the axis of rotation 13. Supporting member 4 and holding member 5 are capable of being pivoted about pivotal axes 14 in order to grip workpiece 23.

In the gear housing 11, toothed segments 15 are mounted on the journal pins 12, which toothed segments 15 mesh with a gear wheel 16 arranged concentrically with respect to the axis of rotation 13. The gear wheel 16 is mounted on a shaft 17 which, in turn, is arranged within the hollow shaft 8. A slip-on drive 18 connected to an electric motor 19, which motor is utilized as a braking motor, is arranged at the free outer extremity of shaft 17. In addition to an electric braking motor, a hydraulic or pneumatic motor can also be used as part of pivot drive 7. In place of the gear drive 15 and 16, a chain drive, a crank drive or another form of mechanical drive can also be utilized in gear housing 11.

The co-rotating slip-on drive 18 is pivotably mounted to the bearing part 6, for example at the chain wheel 10, by means of a holding element 20. For purposes of reinforcement, both bearing parts 6 are interconnected by means of rods 21 (see FIG. 3).

Figure 3:
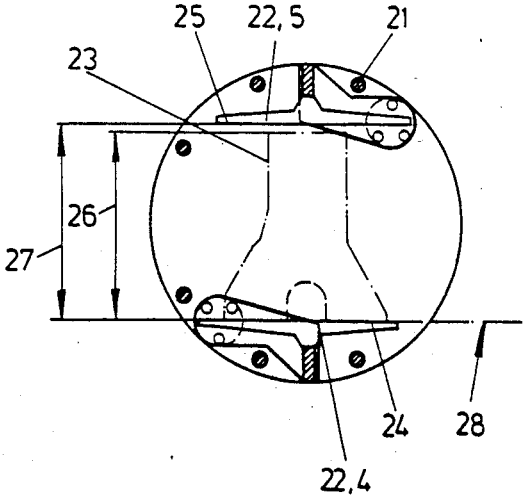
FIG. 3 shows a section along the line III—III of FIG. 1.

As can be seen from FIG. 3, the support member 4 and the holding member 5 each have a grating 22 which, in the illustrated embodiment, are identical.

When the workpiece holding device 3 is designed for holding a variety of workpieces 23, the holding member 5 should include holding claws, which claws are pivotably hinged in a movable manner.

Figure 2:
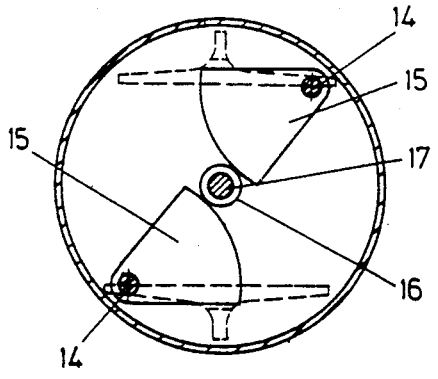
FIG. 2 shows a section along the line II—II of FIG. 1.
Figure 5:
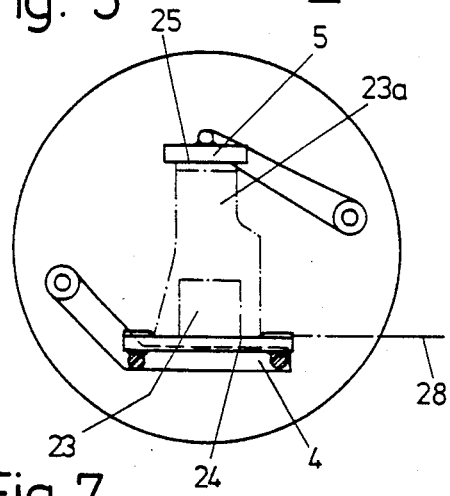
FIG. 5 shows a view in direction A of FIG. 4, in a first working position.
Figure 6:
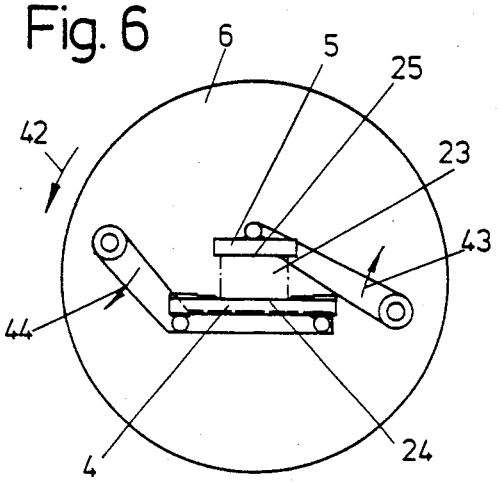
FIG. 6 shows a view corresponding to FIG. 5, in a second working position.

The two gratings 22 have a support plane or face denoted as 24 and a holding plane or face denoted as 25 which, for example, extend in the direction of the pivoting axis 14 of support member 4 or holding member 5 (see FIGS. 2 and 3), as the case may be, or at least the support plane 24 and the holding plane 25 are arranged in each case at the same distance from the respective pivoting axis 14 or from the axis of rotation 13. However, as shown in FIGS. 5 and 6, in a preferred embodiment, support member 4 and the holding member 5 with support face 24 and holding face 25 bend toward each other in the direction toward pivotal axes 14.

In the course of the simultaneous pivoting of the support member 4 and the holding member 5 by means of the pivot drive 7, the distance between the support face or plane 24 and the holding face or plane 25 with respect to the axis of rotation 13 changes uniformly, whereby the two planes always assume a parallel position with respect to one another and remain equidistant from the axis of rotation 13. As a result of this, the workpiece holding device 3 can be adjusted in each case for workpieces 23 of different heights, and the latter are retained in a position which is concentric with respect to the axis of rotation 13. Only a single drive is required for adjusting the holding device and for gripping the workpieces.

For automatic operation of the blasting machine, and for loading the same with different workpieces, the rotation drive 9 and the pivot drive 7 are connected to a control unit (not shown). The control unit includes a microprocessor which is programmed to adjust the distance 27 between support member 4 and holding member 5 in order to accommodate a workpiece having a height 26. The control unit is also programmed to adjust support member 4 by means of rotation drive 9 so that support plane 24 corresponds with a preferably horizontal insertion plane 28, the position of which can be changed. The rotation drive 9 and the pivot drive 7 are each equipped with detection devices 29 and 30 which are known in the art and which detect the position and size of the workpiece 23. This information is communicated to the control unit. After the workpiece 23 is inserted into the blasting chamber 1, the pivot drive 7 is actuated by the control unit, whereby through the simultaneous adjustment of the support member 4 and the holding member 5, the workpiece 23 is tightly retained in a centralized position, and whereby also during the rotation of the workpiece 23, in the course of the blasting treatment, a sufficiently high gripping force is applied through the braking motor 19. The workpiece holding device can also be manually programmed to adjust the distance between support member 4 and holding member 5 to a specified separation.

Figure 4:
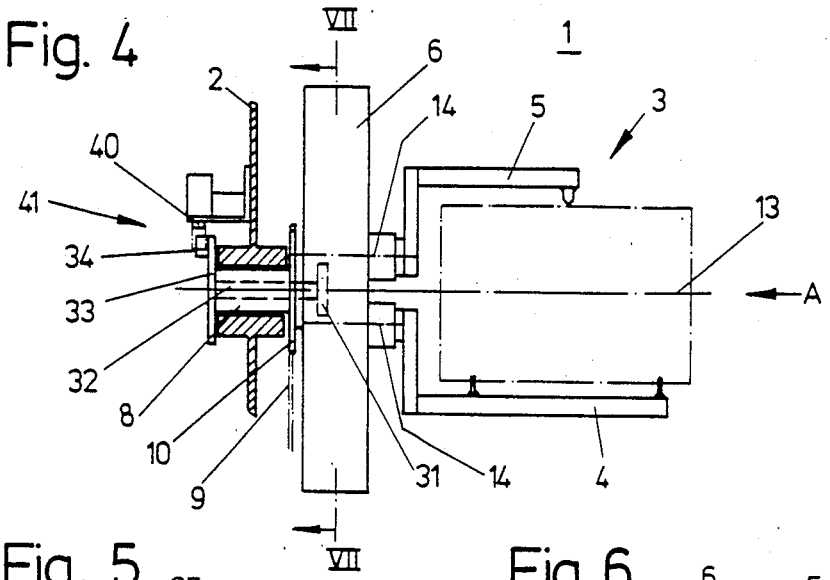
FIG. 4 shows an embodiment of the invention which differs from that of FIG. 1.

In the case of the embodiment shown in FIG. 4, the workpiece holding device 3 is adapted for mounting on a single side wall 2. Thus, the support member 4 and holding member 5 are mounted on one side in a bearing part 6 in a cantilevered manner. For smaller and lighter workpieces, this furnishes a greatly simplified embodiment. The pivot drive 7 can then be designed in a manner corresponding to the one illustrated in FIGS. 1 and 2, or in a further variation of the embodiment, can be designed in the manner described hereinbelow.

In the embodiment shown in FIGS. 4 to 8, the bearing part 6 is rotatably mounted in the side-wall 2 of a blasting chamber 1 by means of a hollow shaft, and can be driven by the rotation drive 9 via, for example, a chain wheel 10.

Figure 7:
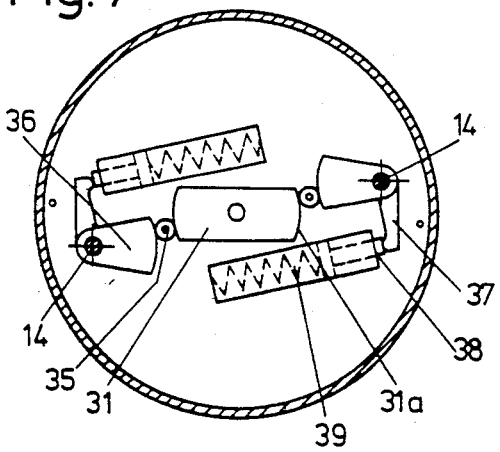
FIG. 7 shows a section along the line VII—VII of FIG. 4, in the working position according to FIG. 5.
Figure 8:
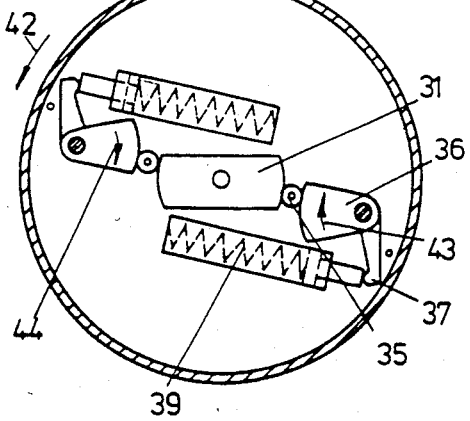
FIG. 8 shows a cross-section similar to that of FIG. 7, in the working position according to FIG. 6.

In accordance with FIGS. 7 and 8, a gear wheel 31 is arranged in the bearing part 6 in a concentric position with respect to the axis of rotation 13, which gear wheel 31 preferably has toothed segments **31*a* on two opposite sides only. The gear wheel 31 is attached at one extremity of a shaft 32 which is rotatably mounted in the hollow shaft 8. A disc 33 with a cam 34 is affixed at the other extremity of shaft 32. Through the intervention of intermediate gear wheels 35, the gear wheel 31 is actively connected to the toothed segments 36 which are arranged on the pivot axes 14. The gear ratio between the gear wheel 31 and the toothed segments 36 is 1:1. At each pivot axis 14, a lever 37 is affixed. By means of a compression piece 38, the stored force of a compression spring 39 is stored at the free end of lever 37. Through this spring force, the the workpiece 23 is held in place between the support plane 24 and the holding plane 25 (FIG. 6). At the side-wall 2, a pin 40 is located which preferably can be displaced pneumatically or hydraulically and, when lowered, together with the cam 34, forms an abutment 41 for the gear wheel 31**. The workpiece holding device can be rotated in the direction shown by arrow A.

The removal of the workpiece 23, retained between the support member 4 and the holding member 5, takes place in the following manner.

During rotation of the workpiece 23, pin 40 (FIG. 4) is pushed into the lower locking position, whereby the co-rotating cam 34 abuts against the pin 40 and whereby the gear wheel 31 is stopped in the position indicated in FIG. 8. In this position, the support plane 24 shown in FIG. 6 is horizontal. Since the bearing part 6 is rotated further in the direction shown by arrow 42 by rotation drive 9, the intermediate gear wheels 35 roll off onto the gear wheel 31 and the toothed segments 36 are pivoted in the direction of the arrows 43 and 44 whereby, in opposition to the pressure of the compression springs 39, the support member 4 and the holding member 5 are pivoted apart respectively in accordance with the direction of arrows 44 and 43. However, since the bearing part 6 continues to rotate in accordance with the direction of arrow 42, the support plane 24 and the holding plane 25 remain in horizontal position, until the support plane 24 corresponds with the insertion plane 28 shown in FIG. 5. At this point, the rotation drive 9 is stopped through an additional switching device which is not illustrated here and is retained in braked position until the workpiece 23, which had been already subjected to the blasting treatment, is removed and a new workpiece 23*a*, displaying eventually a different shape, has been inserted. Subsequently, the rotation drive 9 is temporarily started in opposite rotational direction, i.e., opposite the direction of arrow 42, until an angle of rotation of about 45° is attained. During this rotation of the bearing part 6, the workpiece support member 4 and the holding member 5 are pivoted simultaneously through the force of the springs 39, until the workpiece is tightly retained. After attaining the set angle of rotation, the pin 40 is again lifted upwardly and the direction of rotation of the rotation drive 9 is reversed, as a result of which, the bearing part 6 together with the retained workpiece is rotated in the direction of arrow 42 during the blasting treatment.

Figure 10:
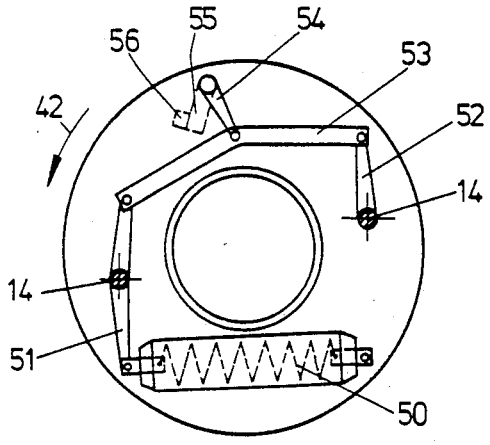
FIG. 10 shows a section along line X—X of FIG. 9.
Figure 9:
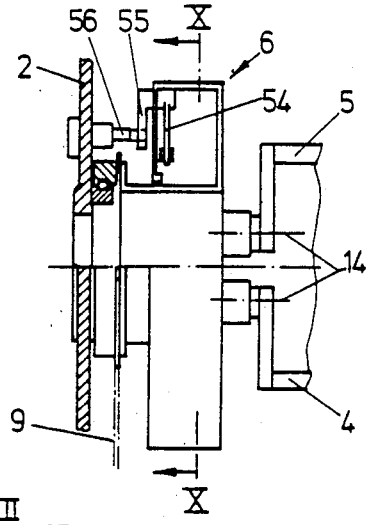
FIG. 9 shows, in a partial longitudinal section, an embodiment of the invention shown in FIG. 4 having a spring action.

FIGS. 9 and 10 show another embodiment having a spring 50 connected to the pivot drive. Herein, the bearing part 6, which can be driven by means of the rotation drive 9, contains a tension spring 50 which exerts a force on a two-armed lever 51. Lever 51 is mounted so as to pivot about one of the pivot axes 14. This two-armed lever 51 is connected via a linkage 53 to a lever 52 which is also mounted to pivot about the second pivot axis 14. To the linkage 53, still another lever 54 is hinged, which in turn is pivotably mounted to the bearing part 6. Outside the bearing part 6, lever 54 is connected in a rotation resistant manner to a stop-lever 55 which, in turn, is engaged by a fixed abutment 56. During the rotation of the bearing part 6 in the direction of arrow 42 by means of the rotation drive 9, the stop-lever 56 is simultaneously pivoted in the opposite direction, as a result of which the support member 4 and the holding member 5 are pivoted away from one another in opposition to the tension of spring 50. The mode of operation of this embodiment corresponds to the mode of operation of the embodiment shown in FIGS. 4 to 8 wherein the compression springs 39 correspond to the tension spring 50, the gear drive corresponds to the linkage 53, and the cam 34 corresponds to the stop-lever 55.

Figure 11:
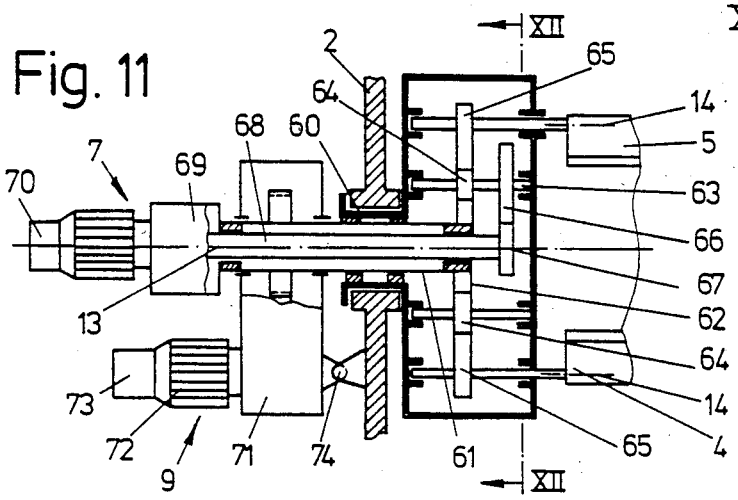
FIG. 11 shows, in a partial longitudinal section, another embodiment of the invention shown in FIG. 1.
Figure 12:
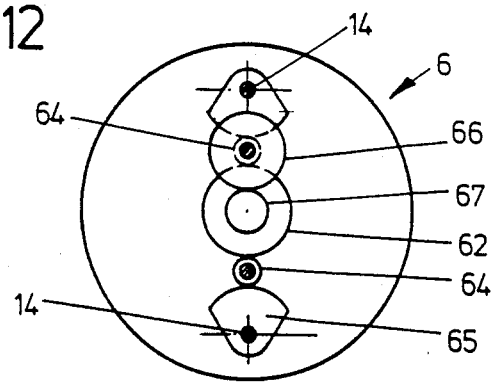
FIG. 12 shows a section along the line XII—XII of FIG. 11.

FIGS. 11 and 12 show another embodiment having one motor driven rotation drive 9 and one motor driven pivot drive 7. The bearing part 6, with the pivot axes 14 arranged therein in a pivotable manner, is rotatably mounted in the side-wall 2 by means of a first hollow shaft 60. Within the first hollow shaft 60, a second hollow shaft 61 is rotatably mounted. At the end of shaft 61, which extends into the bearing part 6, a gear wheel 62 is located which engages with intermediate gear wheels 64. Gear wheels 64 are rotatably mounted to the bearing part 6 by means of shafts 63. Toothed segments 65, which are mounted in a rotation-resistant manner on the pivotal axes 14, engage with intermediate gear wheels 64. The gear ratio between the gear wheel 62 and the toothed segments 65 is 1:1. At one of the shafts 63, an additional gear wheel 66 is mounted, which engages with a gear wheel 67. Gear wheel 67 is arranged concentrically with respect to the axis of rotation 13. Within the bearing part 6, gear wheel 67 is affixed at the end of the shaft 68 which, in turn, is rotatably mounted in the second hollow shaft 61, whereby this shaft 68 can be driven by a geared motor 69 which is attached at the end of the second hollow shaft 61 and is provided with a brake 70. The second hollow shaft 61 can be driven by a slip-on drive 71 and a driving motor 72 which is likewise provided with a brake 73. This driving motor 72 is attached to the side-wall 2 by means of a torque support 74. By means of the pivot axes 14, the support member 4, which is either connected to both sidewalls (FIG. 1) or to only one side-wall (FIG. 4), and the holding member 5 can be rotated simultaneously, as has been described before.

For the rotation of the workpiece, the gear wheel 67 is connected in a rotation-resistant manner to the second hollow shaft 61, which is driven by the driving motor 72. Due to the braking effect of brake 70, the intermediate gear wheels 64 cannot rotate about the gear wheels 66 and 67, and the entire bearing part 6 together with the workpiece which is held in a centralized position, is rotated around the axis of rotation 13. For loading and unloading the workpiece, the bearing part 6 is retained in such a manner by switches, which are not shown, so that, in the lower position, the workpiece support plane 24 extends horizontally. When rotation drive 9 is braked, through the intervention of the geared motor 69, via gear wheels 67, 66, via the intermediate gear wheels 64, and via the toothed segments 65, the workpiece support member 4 and the holding member 5 are pivoted either toward one another or away from one another depending on the direction of rotation of the geared motor 69. Through the simultaneous rolling off of the intermediate gear wheels 63 onto the gear wheel 62, the bearing part 6 is rotated in each case in such a manner that the support plane 24 always extends horizontally. For the insertion of a new workpiece, the two planes 24 and 25 are moved that far apart from one another, so that support plane 24 lies at the same height as a horizontal insertion plane 28 (see FIG. 5).

In this embodiment, as well as in the embodiments illustrated by FIGS. 1 to 8 or FIGS. 9 and 10, the pivot axes 14 are mechanically coupled with rotation of the bearing part 6 so that the support plane 24 always remains horizontal when the device is loaded or unloaded. This has the advantage that during the gripping operation of the workpiece, no slippage of the workpiece, which is inserted in a centralized manner, can take place, and that during loading or unloading, the insertion plane 28 always corresponds with the support plane 24.

Figure 13:
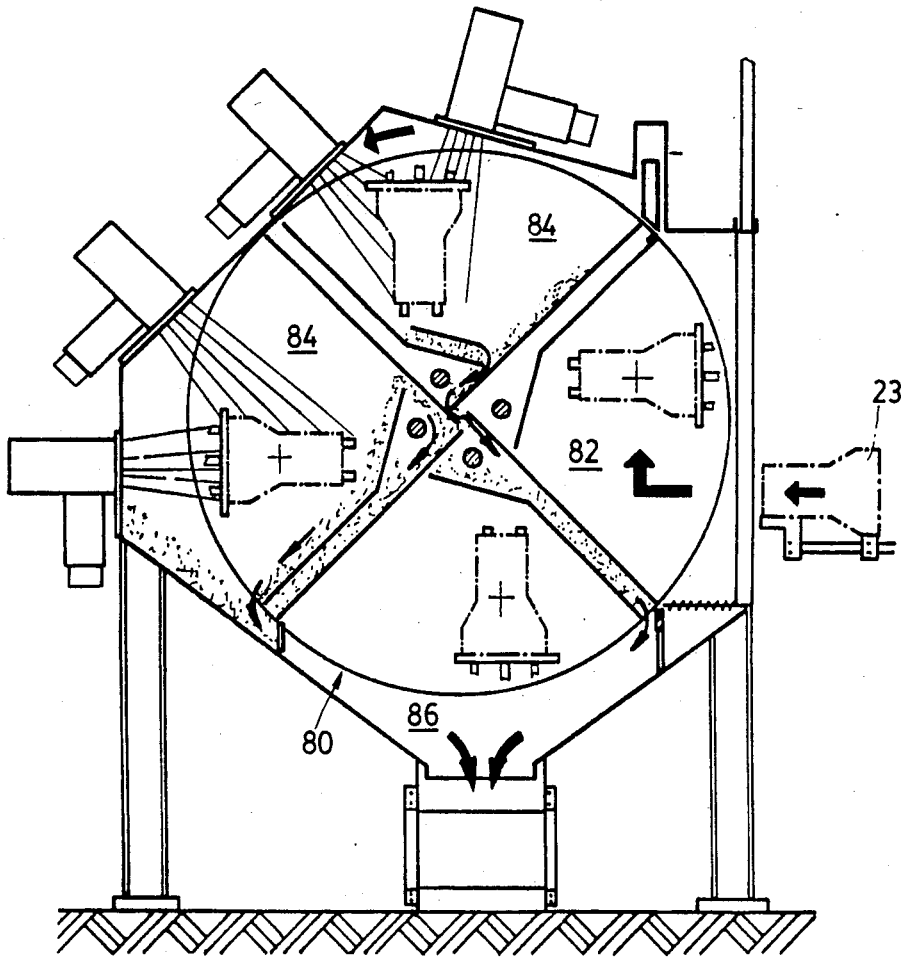
FIG. 13 shows a multi-station centrifugal blasting system utilizing the workpiece holding device of the present invention.

The side-walls 2 illustrated in FIGS. 1, 2, 9 and 12, can be a section of a multi-station blasting machine's drum-conveyor revolving around a horizontal axis, wherein several of the previously described workpiece holding devices are arranged about the perimeter. FIG. 13 illustrates such a multi-station drum conveyor. The workpieces 23 are transported on drum conveyor 80 from a loading and unloading station 82 through one or several blasting stations 84 and through a station 86 for removing the blasting material.

The described workpiece holding devices can also be arranged between bearing cross-bars of an overhead conveyor, by means of which the workpieces are transported from a loading station, through at least one blasting chamber, to an unloading station.

Such conveying devices for centrifugal blasting machines are described in the previously mentioned European Patent Application No. 100,944.

While the invention has been described by reference to specific embodiments, this was for purposes of illustration only and should not be construed to limit the spirit or the scope of the invention.

What is claimed is:

1. A rotatable workpiece holder for holding a workpiece subjected to a blasting treatment in a centrifugal blasting machine, comprising a support member having a support plane, a holding member having a holding plane, a bearing member for rotatably bearing said support member and said holding member, rotation drive means for rotating said support member and said holding member about an axis of rotation, said support member and said holding member being diametrically opposed to one another about said axis of rotation, and adjustment means for pivotally adjusting the distance between said support member and said holding member to receive said workpiece, said support member and said holding member being pivoted about respective pivot axes, said pivot axes being parallel to said axis of rotation and being diametrically opposed to one another about said axis of rotation, said support plane and said holding plane being adjusted simultaneously so that they are at all times parallel to each other and equidistant from said axis of rotation.

2. The workpiece holder of claim 1 wherein said bearing member includes two side walls supporting said support member and said holding member.

3. The workpiece holder of claim 1 wherein said adjustment means comprises a pivot drive having a drive member concentric with said axis of rotation, driven members in engagement with said drive member, said driven members connected to said support member and said holding member, and drive means for driving said drive member.

4. The workpiece holder of claim 3 wherein said drive member and said driven members are in toothed engagement with each other.

5. The workpiece holder of claim 4 wherein said driven members are coaxial with said pivot axes.

6. The workpiece holder of claim 5 wherein said drive means comprises electric drive means.

7. The workpiece holder of claim 5 wherein drive means comprises hydraulic drive means.

8. The workpiece holder of claim 5 wherein said drive means comprises pneumatic drive means.

9. The workpiece holder of claim 1 further comprising a central control unit for controlling operation of said rotation drive means and said adjustment means.

10. The workpiece holder of claim 9 further comprising detection means for detecting the height of said workpiece, said detection means being in data communication with said central control unit.

11. The workpiece holder of claim 1 wherein said rotation drive means and said adjustment means are mechanically interconnected.

12. The workpiece holder of claim 1 wherein said adjustment means includes at least one spring and linkage means linking said spring to said support member and to said holding member said spring supplying a force to said support member and said holding member for retaining said workpiece.

13. The workpiece holder of claim 12, wherein said spring is a compression spring and said linkage comprises toothed segments mounted on said support member and said holding member coaxially with said pivot axes, a gear wheel concentric with said axis of rotation, said gear wheel being engaged with said toothed segments, a cam which is mounted on said gear wheel, and releasable stop means for engaging said cam.

14. The workpiece holder of claim 12 wherein said spring is a tension spring and said linkage comprises levers located on said pivotal axes of said support member and said holding member, rods mechanically linking said levers to each other, and stop means releasably connected to said rods.

15. The workpiece holder of claim 1 wherein said adjustment means includes a first gear wheel concentric with said axis of rotation, a second gear wheel concentric with said axis of rotation and turning with said first gear wheel, toothed segments mounted on said support member and said holding member coaxially with said pivot axes, intermediate gear wheels linking said first gear wheel with said toothed segments, and a third gear wheel which is connected in rotation-resistant manner to at least one of said intermediate gear wheels and to said second gear wheel.

16. The workpiece holder of claim 15 wherein said first gear wheel is mounted on a hollow outer shaft driven by a first drive motor, and said second gear wheel is mounted on an inner shaft located within said hollow shaft, said inner shaft being driven by a second drive motor.

17. The workpiece holder of claim 1 wherein said support plane and said holding plane are at the same distance from their respective pivot axes.

18. The workpiece holder of claim 17 further comprising arms connecting said support member and said holding member to said adjustment means, said arms extending at an angle from said pivot axes.

19. The workpiece holder of claim 1, wherein said support member and said holding member are identical.

20. A centrifugal blasting machine comprising a loading station, an unloading station, an unloading station, a blasting station, and a conveyor for transporting a workpiece to said stations, said conveyor including a plurality of workpiece holding devices comprising a support member having a support plane, a holding member having a holding plane, a bearing member for rotatably bearing said support member and said holding member, rotation drive means for rotating said support member and said holding member about an axis of rotation, said support member and said holding member being diametrically opposed to one another about said axis of rotation, and adjustment means for rotating said support member and said holding member about an axis of rotation, and adjustment means for pivotally adjusting the distance between said support member and said holding member to receive said workpiece, said support member and said holding member being pivoted about respective pivot axes, said pivot axes being parallel to said axis of rotation and being diametrically opposed to one another about said axis of rotation, said support plane and said holding plane being adjusted simultaneously so that they are at all times parallel to each other and equidistant from said axis of rotation.

21. The centrifugal blasting machine of claim 20 wherein said conveyor comprises a drum conveyor adapted for rotation about a horizontal axis and wherein said plurality of workpiece holding devices are arranged within said drum conveyor.

22. The centrifugal blasting machine of claim 20 wherein said conveyor is an overhead conveyor.

* * * * *